United States Patent [19]

Suzuki

[11] 4,094,240

[45] June 13, 1978

[54] MACHINE FOR SHEARING AND COMPRESSING SCRAP METALS

[76] Inventor: Masao Suzuki, 880 Sezaki-cho, Soka-shi, Saitama-ken, Japan

[21] Appl. No.: 703,761

[22] Filed: Jul. 9, 1976

[30] Foreign Application Priority Data

Apr. 8, 1976 Japan ..... 51-042563

[51] Int. Cl.[2] ..... B30B 15/08

[52] U.S. Cl. ..... 100/97; 100/DIG. 1; 100/215; 100/218; 100/232; 100/233; 100/295; 83/923

[58] Field of Search ..... 100/215, 218, DIG. 1, 100/96, 97, 39, 232, 233, 295, 98 R; 83/923

[56] References Cited

U.S. PATENT DOCUMENTS

| | | | |
|---|---|---|---|
| 2,984,174 | 5/1961 | Jones | 100/215 X |
| 3,545,369 | 12/1970 | Tokushima | 100/98 R |
| 3,752,064 | 8/1973 | Suzuki | 100/98 R |
| 3,965,812 | 6/1976 | Oberg | 100/215 X |

FOREIGN PATENT DOCUMENTS

| | | | |
|---|---|---|---|
| 1,003,139 | 9/1965 | United Kingdom | 100/98 R |

*Primary Examiner*—Billy J. Wilhite
*Attorney, Agent, or Firm*—Arthur T. Fattibene

[57] ABSTRACT

The present invention relates to an improved machine for shearing and compressing scrap metals, in particular, a large scrap metals, such as an automobile. The machine includes a carriage defined by a pair of spaced apart plates, a rigid base disposed between said spaced apart plates to define a U-shaped cross-section, an arm member having a drive motor operatively connected thereto and a supply table having a drive motor operatively connected thereto. A pivot is provided for pivotally mounting the arm member between the pair of spaced apart plates whereby the arm member pivots toward and away from the base. Another pivot is provided for pivotally mounting the supply table at the end of the carriage whereby the supply table rises in order to supply the scrap metals placed thereon onto the base. The supply table is further provided with a put-out table for serving to exhaust the compact block of scrap metals from the machine with the action of the supply table. Complementary blades are connected along opposed edges of the base and the arm member and are adapted to effect a shearing action when the arm member pivots toward the base. A ram member having a drive motor operatively connected thereto is slidably disposed on the base, between the base blades and between the base and the arm member, whereby the sheared scrap metals are compressed into a compact block.

5 Claims, 5 Drawing Figures

FIG. 2
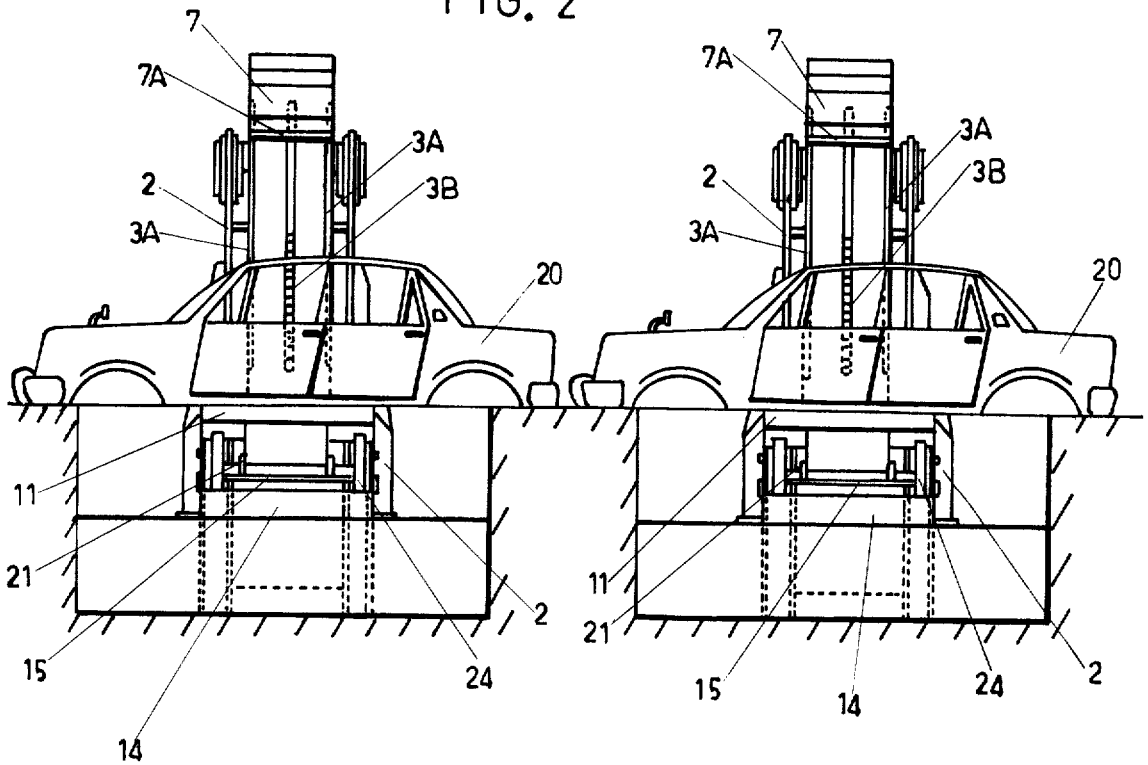
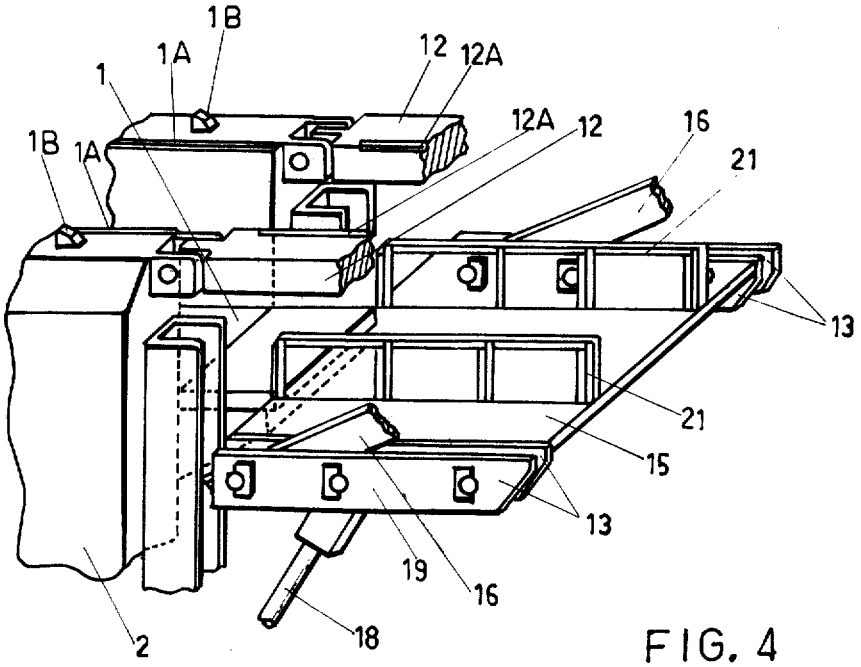
FIG. 4

MACHINE FOR SHEARING AND COMPRESSING SCRAP METALS

BACKGROUND OF THE INVENTION

The present invention relates in general to an improved machine for shearing and compressing scrap metals which is driven by fluid motors, in particular, to a machine which serves to safely and effectively shear and compress large scrap metals, such as an automobile, into a compact and dense forms.

Large scrap metals are conventionally formed into a compact block by a machine for shearing and compressing scrap metals, such as a lever type machine. However, in operation of such lever type machine, scrap metals are frequently rushed or slipped out of a place between a blade of a base and a blade of a press member. Moreover, when it is about to place such large scrap metals on the base, the press member in the upright state interrupts in a crane operation whereby the operation cannot but depend on a fork lift truck. Accordingly, in operation of the conventional type machine, it is attended with various dangers and it is difficult to raise the level of working efficiency.

The present invention is to provide, therefore, an improved machine for shearing and compressing scrap metals without the above-mentioned defects noted in the conventional or known type machines.

SUMMARY OF THE INVENTION

In accordance with the present invention, the improved machine comprises a carriage which is defined by a pair of spaced apart plates having L-shaped sides. A rigid base is disposed between said spaced apart plates to define a U-shaped cross-section and it is, provided with a pair of blades along opposed upper edges thereof and with several saw blades spaced along both outer sides of the pair of blades as occassions demand. An arm member is mounted on the foot portion of the carriage so as to pivot toward and away from the rigid base, and it has a pair of blades along opposed lower edges thereof which are complementary with the blades of the rigid base. The arm has a limb portion which cooperates with a ram for compressing scrap metals therebetween. The arm is operatively connected to a drive motor which is provided on the top portion of the carriage. A supply table is pivotally mounted on the end portion of the carriage and it is provided with a linkage assembly at the rear thereof which is actuated by a drive motor to rise the supply table between operative and inoperative positions so as to supply the scrap metals placed thereon onto the rigid base. The linkage assembly is provided with a put-out table thereon which is level with the cavity portion of the rigid base, and a ram member is arranged in the cavity portion of the base so as to be capable of sliding over the length of the cavity and is operatively connected to a drive motor at the rear thereof. The ram member is slided in the cavity portion toward and away from the limb portion of the arm member after the shearing operation so as to compress the sheared scrap metals to the compact block.

Accordingly, it is an object of the present invention to provide the improved machine for shearing and compressing scrap metals to compact forms, and it is another object to provide the improved machine which serves to safely and effectively shear and compress large scrap metals.

A more detailed explanation of the present invention is provided in the following description, and is illustrated in the accompanying drawings.

BRIEF DESCRIPTION OF THE DRAWINGS

In the drawings:

FIG. 2 is a front view of FIG. 1;

FIG. 4 is a partially perspective view of FIG. 1 showing the relation of the rigid base and the put-out table.

DESCRIPTION OF PREFERRED EMBODIMENT

Figure 3:
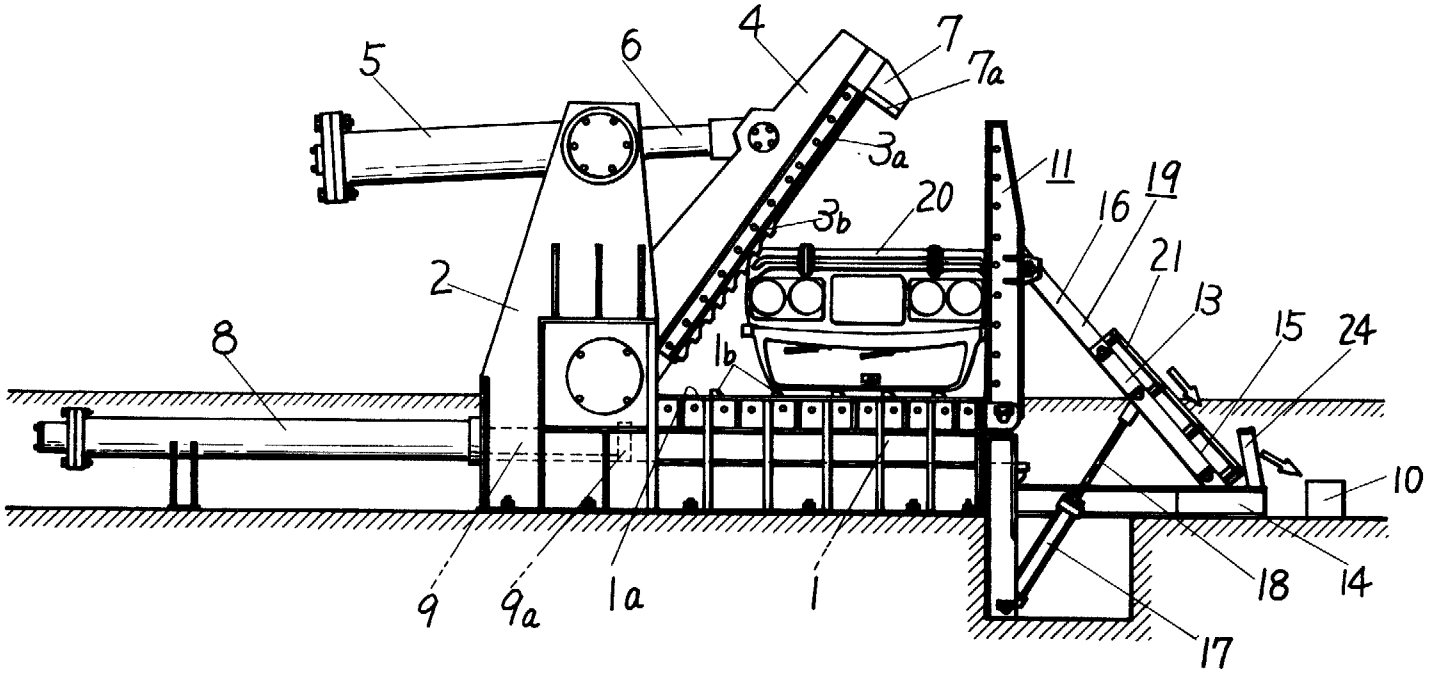
FIG. 3 is a side view of the apparatus of FIG. 1 showing the rising the supply table.

Referring now FIGS. 1 through 4, there is shown the machine of according to the present invention, which is installed in the depression of the ground. The machine includes a carriage 2 defined a pair of spaced apart plates having L-shaped sides respectively. A rigid base 1 having a U-shaped cross-section is integrally formed between the horizontal portions of the spaced apart plates. The rigid base 1 is provided with a pair of longitudinally extending lower blades 1*a* and 1*a* along opposed upper edges thereof and is further provided with several lower saw blades 1*b*, 1*b*, . . . along both outer sides of the pair of the lower blades 1*a* and 1*a*. An arm member 4 is pivotally mounted on the foot portion of the carriage 2 so as to pivot toward and away from the rigid base 1. The arm member 4 is provided with a pair of upper blades 3*a* and 3*a* along opposed lower edges thereof which are complementary with said lower blades 1*a* and 1*a* of the rigid base 1 and is further provided with an upper saw teeth blade 3*b* along the center line between said upper blades 3*a* and 3*a*. The upper saw teeth blade 3*b* has a V-shaped cross-section and is removably attached to the arm member 4. The arm member 4 is operatively connected to a piston rod 6 of a fluid cylinder 5 at the rear thereof whereby the arm member 4 is powered to pivot toward and away from the rigid base 1, and the fluid cylinder 5 is pivotally mounted at the top portion of the carriage 2. A limb portion 7 is formed at the top portion of the arm member 4 and serves to cooperate with ram member 9*a* to compress the scrap metal therebetween after the shearing operation of the arm member 4. The ram member 9*a* is operatively connected to a piston rod 9 of a fluid cylinder 8 at the rear thereof whereby the ram member 9*a* is arranged to slide toward and away from the limb portion 7 of the arm member 4 to effect the compression of the scrap material therebetween after the shearing operation. The rigid base 1 is provided with a supply table 11 at the end portion thereof. The supply table 11 comprises spaced apart leg portions 12—12 with the foot portion of the leg portions 12 and 12 being pivotally mounted on the end portion of the rigid base 1 respectively so that the upper surface of the supply table 11 is nearly level with the upper surface of the rigid base 1. The supply table 11, at the rear thereof, is operatively connected to a linkage assembly 19 which is provided with a put-out table 15 for serving to exhaust the compact block 10 from the machine upon the action of the linkage assembly 19 of the supply table 11. The linkage assembly 19 is operatively connected to a piston rod 18 of a fluid cylinder 17 at the rear thereof whereby the linkage 19 is driven so as to rise the supply table 11 as shown in FIG. 3. The linkage assembly 19 is formed by two links 13 and 16 and is mounted on a mounting bed 14 which has a support 24 for supporting the free end of the supply table 11. The lower link 13 is provided with the put-out table 15 on the surface thereof, and the put-out table 15 is further provided with a pair of guides 21 and 21 for preventing the compact block 10 from dropping out at an undesirable place. In this embodiment, the limb portion 7 is provided with a pair of blades 7*a* and 7*a*, and the supply table 11 is also provided with a pair of blades 12*a* and 12*a* at the insides of the both leg portions 12 and 12 thereof respectively. The blades 7*a*, 7*a*, 12*a* and 12*a* are complementary each other whereby the blades 7*a* and 7*a* are engaged with the blades 12*a* and 12*a* when the supply table 11 is moved into the rised portion and the arm member 4 is moved into the shearing position. Thereby, it is possible to shear the large scrap metal, such as an automobile 20, without any exception.

Figure 1:
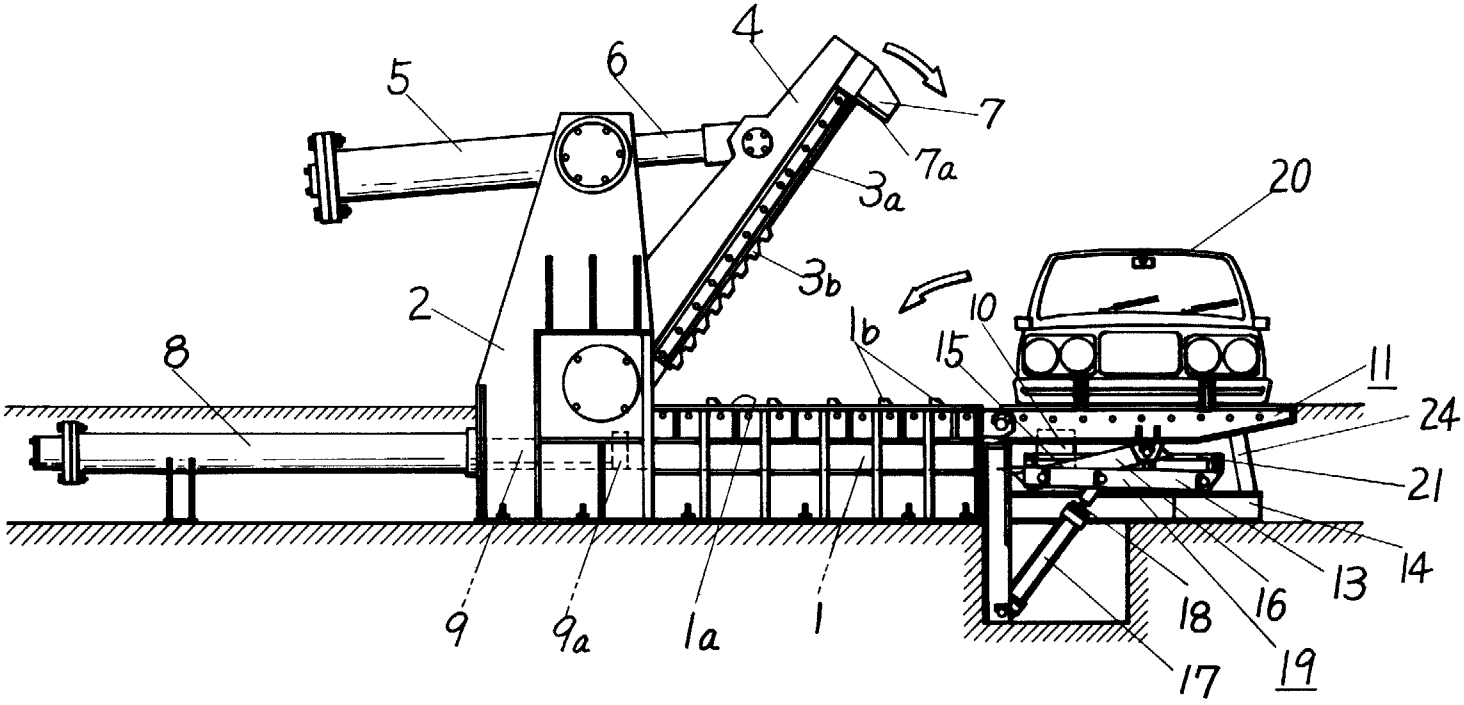
FIG. 1 is a side view of one embodiment according to the present invention illustrating the component parts just prior to the begining of the compressing operation.

In operation of the above embodiment, the scrap metal 20 is placed on the supply table 11 by way of a crane or a fork lift truck, and then, the fluid cylinder 17 is energized so that the supply table 11 rises and supplies the scrap metal 20 onto the rigid base 1 by way of the linkage assembly 19. As shown in FIG. 3, after the scrap metal 20 is placed on the rigid base 1, the fluid cylinder 5 is energized so that the arm member 4 pivots toward the rigid base 1 whereby the upper blades 3*a* and 3*a* of the arm member 4 are engaged with the lower blades 1*a* and 1*a* of the rigid base 1 so as to crush or shear the scrap metal 20. Thereupon, the supply table 11 serves to prevent the scrap metal 20 from rushing or slipping out of the rigid base 1 in the backward direction, and the upper saw blades 3*b*, 3*b*, . . . are bored into the scrap metal 20 whereby it is capable of crushing or shearing effectively the scrap metal 20 because the scrap metal 20 is not slipped out of the engagement point of the blades 1*a*, 1*a*, 3*a* and 3*a*. After the shearing operation of the arm member 4, the fluid cylinder 8 is energized so that the ram member 9*a* compresses the sheared scrap metal in the cavity of the rigid base 1. The ram member 9*a* slides toward the limb portion 7 of the arm member 4 whereby the sheared scrap metal is formed to the compact block 10 between the ram member 9*a* and the limb portion 7. Then, the arm member 4 pivots away from the rigid base 1 and supply table 11 returns to the first state as shown in FIG. 1. After the supply table 11 returns, the ram member 9*a* pushes forward the compact block 10 onto the put-out table 15, and then, the ram member 9*a* returns to the first state. Secondly, a new scrap metal is placed on the supply table 11 and the supply table 11 rises as shown in FIG. 3, whereupon the compact block is slipped off forward the front of the mounting bed 14 of the linkage assembly 19 as the put-out table 15 on the linkage assembly 19 is slanted or inclined. The machine of the above embodiment shears and compresses continuously the scrap metal 20 supplied on the supply table 11 in accordance with the above mentioned operations and exhausts simultaneously the compact block as the product out of the machine. Accordingly, in operation of the machine so long as the scrap metal 20 is supplied on the supply table 11, the scrap metal 20 is sheared and compressed to the compact block 10 and is exhausted out of the machine by movements of the machine which are capable of being controlled automatically.

Figure 5:
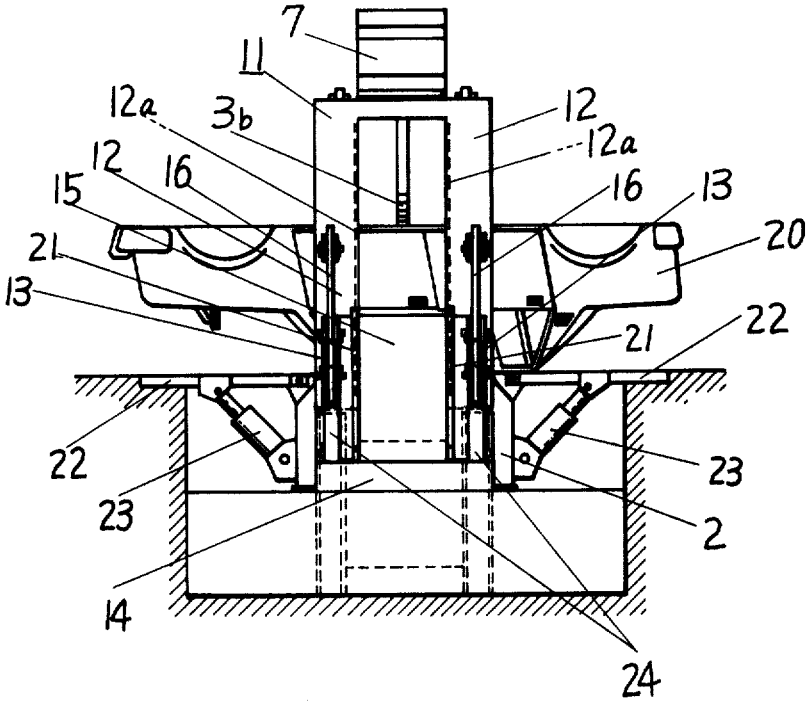
FIG. 5 is a front view of another embodiment of the present invention which is provided with a pair of dump-floors on the both sides of the carriage.

Referring to FIG. 5, there is shown the machine of the second embodiment according to the present invention, which has almost same constructions as the first embodiment except that it includes a pair of dump-floors 22 and 22 disposed on both sides of the carriage 2 located so as to be about level with the upper surface of the rigid base 1. Each dump-floor 22 is operatively connected to a fluid cylinder 23 whereby the dump-floor 22 forms the support for the sheared scrap metal fallen thereon by the shearing action of the arm member 4 onto the rigid base 1. Consequently, in this type machine, it is capable of operation very safely because it is not necessary for one to approach to the machine in operation.

The machine may include a rigid base having plural cavity portions as shown in FIG. 2 and an arm member formed to be complementary with the rigid base as hereinbefore described. Each cavity portion of the rigid base may have an U-shaped cross-section and may be provided with a pair of lower blades along opposed upper edges thereof. The arm member may be provided with upper blades along opposed lower edges thereof, which may be complementary with said lower blades of the rigid base. The arm member may pivot toward and away from the rigid base whereby plural compact blocks of scrap metals may be formed at the same time and may be exhausted out of the machine by way of the put-out table on the link work as hereinbefore described with respect to FIG. 1.

What is claimed is:

1. A machine for shearing and compressing scrap materials comprising:

a pair of spaced apart plates to define a carriage, a base connected to said carriage and disposed between said pair of spaced apart plates, said base having a U-shaped cross-section to define a cavity for receiving the scrap material, an arm pivotally connected at one end to said carriage, said arm having a limb connected at its other end, a drive motor means connected to said arm for driving said arm toward and away from said base, complementary blades connected to said arm and to said base along the respective edges thereof to effect a shearing action on the material adapted to be supported on said base as said arm is pivoted toward said base, a ram slideably mounted along said base, a drive means for actuating the drive of said ram for successively compressing said material between said ram and said limb, and ejecting said compressed material, a supply table pivotally mounted to said base, a linkage assembly connected to said supply table for pivoting said table relative to said base between an operative raised position and an inoperative lowered position, an actuating means connected to said linkage assembly for activating said linkage assembly for moving said supply table between operative raised position and inoperative lowered position, and a put-out table connected to said linkage assembly for receiving the compressed material as said ram pushes the compressed material onto said put-out table whereby said put-out table functions to eject the compressed scrap material as said supply table is raised to position other scrap material to be compressed onto said base.

2. The machine as defined in claim 1 and including a pair of dump floors, said dump floors being disposed to either side of said base at substantially the upper level of said base, means for pivoting each of said dump floors for movement between an operative and inoperative position, and a drive means connected to said dump floors for activating said dump floors between operative support position and inoperative non-support position.

3. The machine as defined in claim 1 and including a series of saw teeth blades removeably connected to said arm.

4. The machine as defined in claim 1 and including a base having a plurality of cavity portions, and an arm complementary with each of said cavity portions.

5. A machine for shearing and compressing scrap material comprising:

a pair of spaced apart plates to define an upright carriage, a base connected to one side of said carriage and disposed between said carriage plates, said base having a U-shaped cross-section to define a cavity for receiving the scrap material to be compressed, an arm pivotally connected at one end to said carriage between said carriage plates, said arm being adapted to extend over said cavity of said base, a drive means connected to said arm for driving said arm toward and away from said base, complementary shear blades connected to said arm and said base along the respective edges thereof to effect a shearing action on the material supported on said base, complementary saw teeth blade spaced along the respective shear blades, a ram slideably mounted on said base within said cavity, a means connected to said ram for activating the drive thereof, a supply table pivotally mounted to the end of said base opposite said carriage, said supply table having opposed leg portions, and said table being adapted to pivot between an operative raised position and an inoperative lowered position, drive means connected to said supply table for activating said supply table between operative and inoperative positions, said supply table being disposed substantially at the upper level of said base in the lowered position thereof, said arm having a depending limb portion adjacent the free end thereof, said limb portion being disposed between the leg portions of said supply table in the raised position of said supply table whereby the scrap material on said base is compressed between said ram and said limb portion upon the actuation of said ram within said cavity, and a put-out table disposed beneath said supply table, said put-out table being operatively connected to said supply table drive means whereby said put-out table ejects the compressed material as said supply table is raised to operative position.

* * * * *